US011041279B2

(12) United States Patent
Knight et al.

(10) Patent No.: US 11,041,279 B2
(45) Date of Patent: Jun. 22, 2021

(54) MARKERS, CULVERT MARKERS, LOCATION MARKERS, COMBINATIONS, AND METHODS OF USE

(71) Applicants: James Darren Knight, Grovedale (CA); Michelle Nadine Knight, Grovedale (CA)

(72) Inventors: James Darren Knight, Grovedale (CA); Michelle Nadine Knight, Grovedale (CA)

( * ) Notice: Subject to any disclaimer, the term of this patent is extended or adjusted under 35 U.S.C. 154(b) by 411 days.

(21) Appl. No.: 15/635,141

(22) Filed: Jun. 27, 2017

(65) Prior Publication Data

US 2018/0371714 A1 Dec. 27, 2018

(51) Int. Cl.
*E01F 9/627* (2016.01)
*E01F 5/00* (2006.01)

(52) U.S. Cl.
CPC ..... *E01F 9/627* (2016.02); *E01F 5/005* (2013.01)

(58) Field of Classification Search
CPC ..... E01F 9/627
USPC ..... 116/63 R
See application file for complete search history.

(56) References Cited

U.S. PATENT DOCUMENTS 3,081,848 A * 3/1963 Nordeng ..... E01F 9/635 52/298
4,275,535 A 6/1981 Stalzer
4,548,379 A 10/1985 Seely et al.
5,199,814 A * 4/1993 Clark ..... E01F 9/629 116/63 P
5,303,524 A * 4/1994 Caspe ..... E04H 9/0237 52/167.2
5,986,237 A 11/1999 Sterling et al.
6,237,268 B1 * 5/2001 Levin ..... G09F 15/0056 248/160
6,267,529 B1 7/2001 Mudryk et al.
6,276,529 B1 8/2001 Feehan, Jr.
6,349,667 B1 2/2002 Rogers et al.
6,604,719 B1 8/2003 Dicke et al.
8,382,317 B1 2/2013 Baker
8,544,912 B1 * 10/2013 Matthews ..... B66C 1/12 294/74

(Continued)

FOREIGN PATENT DOCUMENTS

WO 2010056305 5/2010
WO 2014176631 11/2014

OTHER PUBLICATIONS

Image of Spybase 238, accessed on Jun. 23, 2017, URL=http://www.redstarinnovations.com/details-products.php?productid=138.

(Continued)

*Primary Examiner* — Walter L Lindsay, Jr.
*Assistant Examiner* — Philipmarcus T Fadul
(74) *Attorney, Agent, or Firm* — Robert A. Nissen

(57) ABSTRACT

A culvert marker has a pole connected to the wire rope; a wire rope; and a base. A marker has a structural base; a wire rope extending out of the structural base; and a mast supported by the wire rope. A marker has a structural base; and a wire rope extending out of the structural base, with a central axis defined by the wire rope projecting through an area defined between plural ground-or-support-surface contacting points that are defined by the structural base and are spaced angularly about the central axis. Related methods and combinations are also discussed.

11 Claims, 1 Drawing Sheet

(56) References Cited

U.S. PATENT DOCUMENTS

| | | | | |
|---|---|---|---|---|
| 8,646,196 | B2 * | 2/2014 | Glass, Jr. | G09F 15/0056 40/607.03 |
| 9,135,820 | B2 | 9/2015 | Ando et al. | |
| 9,428,858 | B2 | 8/2016 | Cavallin | |
| 2003/0089551 | A1 * | 5/2003 | Kato | D07B 1/162 182/1 |
| 2008/0067299 | A1 | 3/2008 | Ebel et al. | |
| 2014/0260174 | A1 | 9/2014 | Cavallin | |
| 2014/0303881 | A1 | 10/2014 | Ando et al. | |
| 2015/0293216 | A1 | 10/2015 | O'Dea et al. | |

OTHER PUBLICATIONS

Culvert Savers—1049506, Canadian trademark registration, 1 pages, available at least as early as 2001, URL=http://www.ic.gc.ca/app/opic-cipo/trdmrks/srch/viewTrademark.html?id=1049506&lang=eng.

Iceworm advantage Culvert Savers, screenshots from internet archive, accessed Sep. 30, 2019 but archive saved as of Jan. 28, 2016, URL=https://web.archive.org/web/20160128231814/http://icewormint.com/saving.htm.

Wikipedia, Wire Rope, Screenshots from internet archive, accessed on Sep. 30, 2019, available as early as Dec. 15, 2005, URL=https://web.archive.org/web/20051215000000/en.wikipedia.org/wiki/Wire_rope.

* cited by examiner

MARKERS, CULVERT MARKERS, LOCATION MARKERS, COMBINATIONS, AND METHODS OF USE

TECHNICAL FIELD

This document relates to markers, culvert markers, location markers, combinations and methods of use.

BACKGROUND

Culvert markers such as the ICEWORM™ product secure a vertical pole to a culvert via a spring. The spring permits the marker to deflect upon contact by a lateral force such as from snow being cleared from an adjacent roadway.

SUMMARY

A culvert marker is disclosed comprising: a pole connected to the wire rope; a wire rope; and a base.

A culvert location marker is also disclosed comprising: a structural base defining a plurality of fastener holes for securing the structural base to a culvert in use; and a wire rope extending out of the structural base.

A marker is also disclosed comprising: a structural base; a wire rope extending out of the structural base; and a mast supported by the wire rope.

A marker is also disclosed comprising: a structural base; and a wire rope extending out of the structural base, with a central axis defined by the wire rope projecting through an area defined between plural ground-or-support-surface contacting points that are defined by the structural base and are spaced angularly about the central axis.

In various embodiments, there may be included any one or more of the following features: The structural base comprises a ground-or-support-surface-contacting plate. The ground-or-support-surface-contacting plate underlies a base end of the wire rope in use. The structural base comprises a collar forming a receptacle that receives a base portion of the wire rope. A central axis defined by the wire rope projects through an area defined between plural ground-or-support-surface contacting points, which are defined by the structural base and are spaced angularly about the central axis. The structural base comprises a plurality of fastener holes. The plurality of fastener holes are angularly spaced about a central axis defined by the wire rope. The wire rope comprises plural strands wrapped helically around a central axis defined by the wire rope, with each of the plural strands having plural core wires. A top portion of the mast comprises a reflective marking. A combination comprises a culvert; and the marker, in which the structural base is secured to the culvert. A method comprises securing the structural base of the marker of any one of claims 1-9 to a ground or support surface. A mast is supported by the wire rope.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figures 1, 1A, 1B, 2:
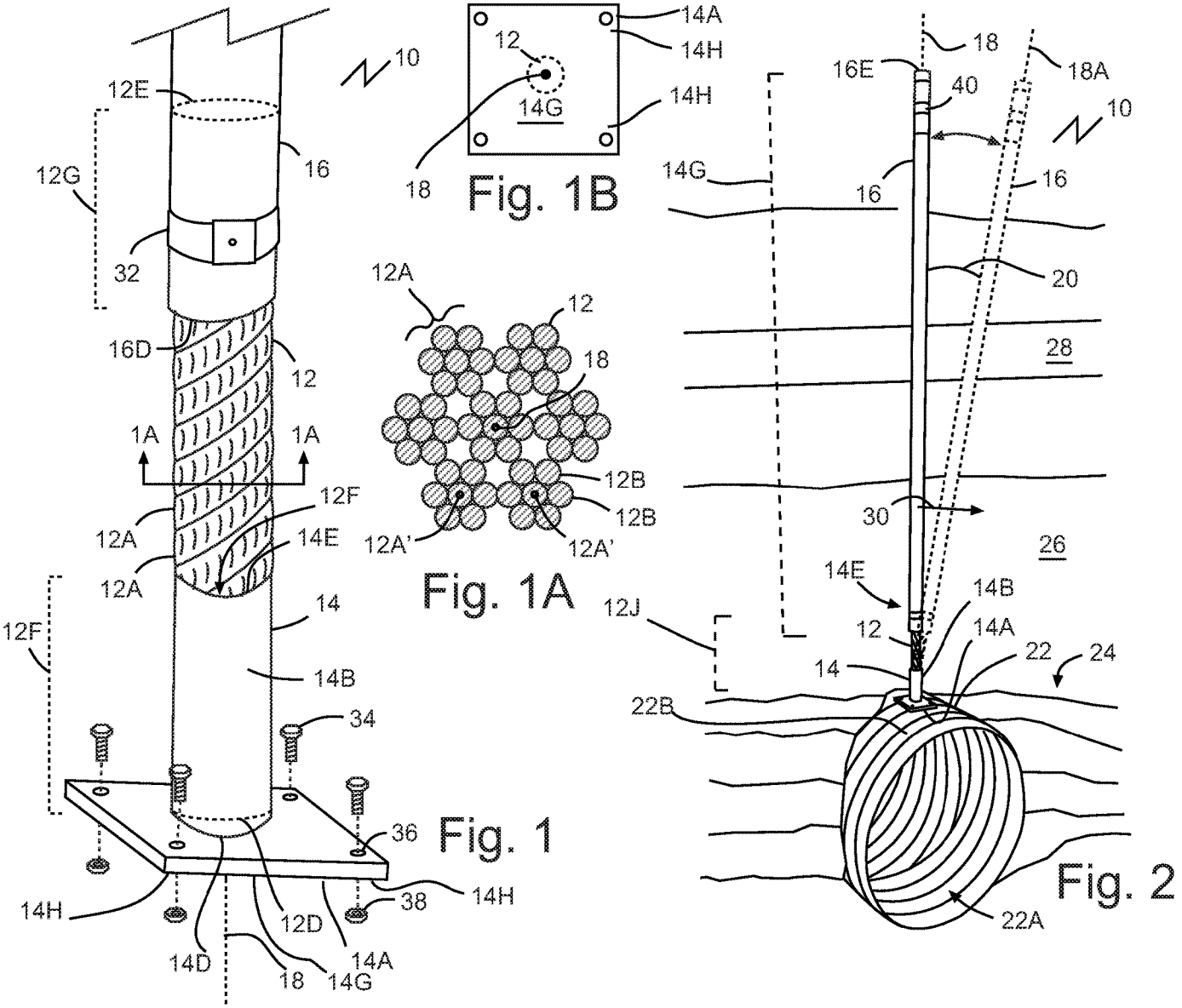
FIG. 1 is a perspective view of a marker.
FIG. 1A is a section view taken along the 1A-1A section lines from FIG. 1.
FIG. 1B is a bottom view of the undersurface of the plate from FIG. 1.
FIG. 2 is perspective view of the marker of FIG. 1 secured to a culvert located near a road.

Immaterial modifications may be made to the embodiments described here without departing from what is covered by the claims.

Markers may be used indicate a position, a geographic feature, a piece of equipment, a place, a route, or to provide other information and visual cues. For example, markers are used to inform motorists travelling along a road or to indicate the location of a particular component, which may at times be at least partially buried under snow or debris or otherwise difficult to visually locate. Markers such as traffic posts may be positioned alongside roadways to help guide traffic along the road, particularly at night when reflectors mounted on such posts indicate the path the road takes into the distance. A marker may comprise a sign positioned in an upright fashion and anchored in the ground, held in place by sand bags or other heavy objects, or spring-mounted on a base, which allows the upright member to bend or deflect relative to the base. Some sign stands provide a spring as a resilient member that couples the upright member or sign to the base.

Markers may be used as roadside devices, which are mounted to the ground, road, or other support surface in a permanent or temporary fashion. Permanent mounting may be achieved using a foundation such as a concrete pile. Other permanent mounting methods include insertion of a pole into the ground, in some cases preceded by drilling a hole and cementing the pole in place within the hole. Many permanently mounted devices that require power may be connected underground to a source of power or control lines. Temporary mounting may be achieved by resting the base on the ground.

Referring to FIG. 2, a marker may include a culvert marker 10, which is a type of marker used to identify a culvert 22, which may be adjacent, for example underground below, a road 28. A culvert is a structure that allows water to flow under a road, railroad, trail, or other obstruction or right-of-way. A culvert may be made from a pipe, reinforced concrete, or other suitable material. A corrugated metal pipe culvert 22 is shown. A culvert may be embedded within the ground, for example laterally penetrating a slope 26 that defines a ditch 24 adjacent the road 28 as illustrated in FIG. 2. A culvert is commonly used as a cross-drain for ditch relief and to pass water, for example between open ends 22A of culvert 22, under a road or right-of-way at natural drainage and stream crossings. Culverts come in many sizes and shapes including round, elliptical, flat-bottomed, pear-shaped, and box-like cross-sectional constructions. Culverts may be constructed of a variety of materials including cast-in-place or precast concrete (reinforced or non-reinforced), galvanized steel, aluminum, or plastic, typically high-density polyethylene.

Culverts and other roadside structures such as guardrails may be damaged by contact with heavy equipment such as snow-clearing equipment, or by debris moved by such equipment. Road graders and heavy equipment often damage or plug culverts, causing expensive culvert repairs, risks to equipment operators, and flooding and erosion due to maintenance equipment operators not knowing where culverts are located. Off-road vehicles or right-of-way mowers may accidentally contact a culvert, causing injuries to drivers and mechanical damage to equipment and culvert. Markers may thus be used to indicate to drivers and other individuals where a culvert or other structure is located so as to permit the driver or individual to avoid the structure. Snowplow operators may accidentally block culverts with compacted snow.

Referring to FIGS. 1 and 2, a marker such as a culvert marker 10 is illustrated comprising a structural base 14 and a wire rope 12. Wire rope 12 may extend out of structural base 14, for example in an upright fashion such as if oriented normal to a ground or support surface contacting plane defined by the base 14. Structural base 14 may be secured by a suitable mechanism to a ground surface or a support surface, such as a top cylindrical surface 22B of an exposed section of the exterior surface of the culvert 22. Referring to FIGS. 1 and 2, location marker 10 may be a roadside marker, a culvert marker, a location marker, or other suitable marker. The structure and configuration of marker 10 may protect marker 10 from being pushed over or damaged by snow or other weather conditions.

Referring to FIGS. 1 and 2, structural base 14 may provide a suitable footing from which to mount and support the wire rope 12. Structural base 14 may comprise a ground-or-support-surface-contacting plate 14A. Referring to FIG. 1, ground-or-support-surface-contacting plate 14A may underlie a base end 12D of the wire rope 12 in use. Referring to FIGS. 1 and 1B, a central axis 18 defined by the wire rope 12 may project through an area, in this case the under surface 14G of the plate 14A, defined between plural ground-or-support-surface contacting points, for example four corners 14H, that are defined by the structural base 14 and are spaced angularly about the central axis 18. The area may be defined by perimeter lines that connect the ground-or-support-surface contacting points. In the example of a plate 14A, the area would be defined as a rectangle. Referring to FIG. 1, wire rope base end 12D of the wire rope 12 may contact a ground surface or other support surface, or may be suspended above a ground or other support surface. A hole may be provided in the plate 14A coaxially with the wire rope 12. In some cases (not shown) the structural base 14 has discrete ground-or-support-surface-contacting parts, such as plural legs angularly spaced about the central axis 18 defined by the wire rope 12.

Referring to FIG. 2, structural base 14 may have a configuration suitable for securing or mounting structural base 14 to culvert 22 or other support or ground surfaces. Referring to FIG. 1, structural base 14 may comprise a plurality of fastener holes 36, for example two, three, four or more holes as shown. Fastener holes 36 may permit structural base 14 to be secured to culvert 22, for example via bolts 34 and nuts 38. The plurality of fastener holes 36 may be angularly spaced about the central axis 18 defined by the wire rope 12, for example in ninety degree increments in the example shown. Referring to FIG. 2, structural base 14 may be connected to culvert 22 via a suitable mechanism for example welding, nails, screws, anchors, adhesives, or other suitable fasteners.

Referring to FIGS. 1 and 2, structural base 14 may have a structure suitable for receiving and mounting wire rope 12. Referring to FIG. 1, structural base 14 may comprise a collar 14B forming a receptacle that receives a base portion 12F of the wire rope 12, for example defined as the portion of wire rope 12 between wire rope base end 12D and collar top end 14E. Wire rope base end 12D or another part of the wire rope base end 12D may rest on collar base wall 14D. The wire rope 12 may be connected to the collar 14B by a suitable method such as tack-welding about a complete circumference of the collar 14B. The collar 14B may be connected to the plate 14A by a suitable method such as by welding about a circumference of the collar 14B. Referring to FIGS. 1 and 2, structural base 14 may comprise a sleeve, a slot, a shaft such as a cylindrical shaft, an I-beam, a C-channel, a hole, or other structure suitable for receiving wire rope 12.

Wire ropes are used in a variety of industrial applications. A wire rope is a type of rope made with strands of metal or steel wire laid or twisted into a helix, sometimes around a core. This core can be one of three types. The first is a fiber core, made up of synthetic or natural material. Fiber cores are the most flexible and elastic, but are easily crushed and thus not suitable for heavy loads. The second type, wire strand core, is made up of one additional strand of wire, and is typically used for suspension. The third type is independent wire rope core, which is the most durable in all types of environments.

Referring to FIGS. 1, 1A, and 2, a wire rope 12 may be used as a resilient part that is biased into an upright position, for example a vertical position as shown in use, and that permits deflection upon exposure to lateral forces above a predetermined threshold. The wire rope 12 may be provided with a sufficient diameter, length, material, and construction in order to stand upright in the absence of lateral forces. The wire rope 12 may have a structure suitable for permitting a limited range of bending or to prevent kinking of wire rope 12. Referring to FIG. 1A, wire rope 12 may comprise plural strands 12A wrapped helically around the central axis 18 defined by the wire rope 12, with each of the strands 12A having plural core wires 12B. Each of the outer strands 12A may define a respective outer strand axis 12A'. Each core wire 12B may be made of a suitable material, such as steel, for example if galvanized steel cables are used. In the example shown a wire rope 12 is made of a central core strand surrounded by plural outer strands.

Referring to FIGS. 1 and 2, marker 10 may comprise a mast 16, for example supported by wire rope 12. Mast 16 may be a tube, pole, sleeve or other suitable structure, for example a plastic tube. The tube may be resilient. The tube may be constructed in a variety of colors. Referring to FIG. 2, a portion, such as a top portion, adjacent or defined at a top end 16E, of the mast 16 may comprise a marking, for example a reflective marking 40. The marking provides a visual reference to catch the attention of a nearby user or driver as to the presence of the marker. Referring to FIGS. 1 and 2, mast 16 may be secured to wire rope 12 via a suitable mechanism such as a hose or band clamp 32, welding, adhesive, and others.

Referring to FIG. 2, wire rope 12 may be structured in a suitable fashion. The wire rope 12 may extend part way up an axial length 16G of mast 16. By using a wire rope 12 whose axial length 12J is relatively short compared to the axial length 16G of mast 16, the relatively denser wire rope 12 remains near the base of the device, and the center of gravity of the marker 10 may be lower than if the wire rope 12 extended along a substantial part of or the entirety of the axial length 16G entirely. Referring to FIG. 1, a top portion 12G of wire rope 12 may connect to mast 16, for example as shown where the portion 12G is received within a receptacle defined by mast 16 via an opening at a base end 16D of mast 16. Top portion 12G, for example defined by mast base end 16D and wire rope top end 12E, may be a suitable axial length for example between four to six inches in length.

Referring to FIG. 2, wire rope 12 may form a resilient interconnection, form example a cantilever connection, between the structural base 14 and the mast 16 that permits the mast 16 to deflect from the central axis 18 defined by the wire rope 12 when a lateral force, for example a force with a non-zero force vector component oriented a direction 30 perpendicular to axis 18, is applied to the mast 16 and to return to the central axis 18 when the lateral force is no longer applied to the mast 16. In some cases, the wire rope 12 causes the mast 16 to return to the neutral, vertical position shown by non-dashed lines, even when the mast 16 must push through snow to do so. A non-zero angle of deflection 20 from neutral may be defined by the wire rope 12 when in a deflected position, and a vertex at collar top end 14E defined by the wire rope 12 when in a deflected position.

As above, markers may function as traffic control devices. Traffic control devices include markers, signs and signal devices used to inform, guide and control traffic, including pedestrians, motor vehicle drivers and bicyclists. Such devices are usually placed adjacent, over or along the highways, roads, traffic facilities and other public areas for traffic control. Traffic signs include signs that use symbols or words to convey information to road users. Traffic signs may convey regulatory, warning, or advertising information. Traffic lights include traffic control devices used for alternately assigning right-of-way to traffic moving in conflicting directions at an intersection.

Marker 10 may be positioned adjacent a cement barricade, adjacent or on a guard rail, mounted to the ground, such as directly on the road itself, or in other suitable configurations. Wire rope 12 may have first and second axial portions, for example positioned within structural base 14 and mast 16 respectively, with one portion secured to the base 14 and the other to the mast 16 or other indicator portion such as a sign. Wire rope 12 may depend from base end 12D the mast 16. Wire rope 12 may be constructed to support the mast 16 in an upright position when the marker 10 is not loaded with any lateral force. Wire rope 12 may support mast 16 in a vertical position. Wire rope 12 may be a wire rope suitable to form a winch line for a vehicle or industrial equipment. Structural base 14 may depend from base end 12D of wire rope 12. Structural base 14 may form an anchor, a foot, or a support base. Structural base 14 may be mounted on top of a guardrail post, for example to indicate to grader operators that a guardrail extends into the ground below a snowbank. Mast 16 may support a sign or may form a sign. Mast 16 may be a pole or a post. In this disclosure, words such as up, down, top, bottom, lateral, base, above, and below are relative and not intended to be restricted to absolute orientations based on the direction of gravitational acceleration on the Earth, unless context dictates otherwise.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A marker comprising:

a structural base;

a wire rope;

a mast; and in which the wire rope extends out of the structural base and supports a base end of the mast, with the base end of the mast separated from the structural base by the wire rope so that the wire rope supports a weight of the mast and maintains the mast in an upright position, with the wire rope forming a resilient interconnection between the structural base and the mast to permit the mast to deflect from a vertical, central axis defined by the wire rope, in which the wire rope comprises plural strands wrapped helically around, with the wire rope having a core of flexible material that defines the vertical, central axis.

2. The marker of claim 1 in which the structural base comprises a ground-or-support-surface-contacting plate.

3. The marker of claim 2 in which the ground-or-support-surface-contacting plate underlies a base end of the wire rope in use.

4. The marker of claim 1 in which the structural base comprises a collar forming a receptacle that receives a base portion of the wire rope.

5. The marker of claim 1 in which a central axis defined by the wire rope projects through an area defined between plural ground-or-support-surface contacting points, which are defined by the structural base and are spaced angularly about the central axis.

6. The marker of claim 1 in which the structural base comprises a plurality of fastener holes.

7. The marker of claim 6 in which the plurality of fastener holes are angularly spaced about a central axis defined by the wire rope.

8. The device of claim 1 in which the wire rope comprises plural strands wrapped helically around a central axis defined by the wire rope, with each of the plural strands having plural core wires.

9. The device of claim 1 in which a top portion of the mast comprises a reflective marking.

10. A combination comprising:

a culvert; and the marker of claim 1 in which the structural base is secured to the culvert.

11. A method comprising securing the structural base of the marker of claim 1 to a ground or support surface.

* * * * *